US005262589A

United States Patent [19]

Kesler

[11] Patent Number: 5,262,589

[45] Date of Patent: Nov. 16, 1993

[54] HIGH VELOCITY PROPAGATION RIBBON CABLE

[75] Inventor: Matt Kesler, Phoenix, Ariz.

[73] Assignee: W. L. Gore & Associates, Inc., Newark, Del.

[21] Appl. No.: 709,681

[22] Filed: Jun. 3, 1991

Related U.S. Application Data

[63] Continuation-in-part of Ser. No. 550,761, Jul. 10, 1990.

[51] Int. Cl.[5] ..... H01B 7/34

[52] U.S. Cl. ..... 174/36; 156/53; 156/55; 156/56; 174/117 F

[58] Field of Search ..... 174/36, 117 F, 117 FF, 174/117 R; 156/53, 55, 56

[56] References Cited

U.S. PATENT DOCUMENTS

| | | | |
|---|---|---|---|
| 4,423,282 | 12/1983 | Suzuki et al. | 174/36 |
| 4,443,657 | 4/1984 | Hill et al. | 174/117 F X |
| 4,492,815 | 1/1985 | Maros | 174/36 X |
| 4,567,321 | 1/1986 | Harayama | 174/117 F |
| 4,645,868 | 2/1987 | Suzuki | 174/117 F |
| 4,701,576 | 10/1987 | Wada et al. | 174/117 F |
| 4,707,671 | 11/1987 | Suzuki et al. | 174/117 F |
| 4,972,041 | 11/1990 | Crawley et al. | 174/36 |
| 4,978,813 | 12/1990 | Clayton et al. | 174/117 F |
| 4,988,835 | 1/1991 | Shah | 174/117 F |
| 5,025,115 | 6/1991 | Sayegh et al. | 174/117 F |
| 5,030,794 | 7/1991 | Schell et al. | 174/36 |

OTHER PUBLICATIONS

Cable Guide Brochure—W. L. Gore & Associates, Inc.

*Primary Examiner*—Morris H. Nimmo

*Attorney, Agent, or Firm*—Gary A. Samuels

[57] ABSTRACT

An electrical ribbon cable of parallel, coplanar conductive wires having an insulating layer of sintered porous PTFE tape around each of the wires, and a second insulating layer of porous sintered PTFE film around the wires. A conductive layer is then applied and then an outer insulating layer. The cable may be simply and quickly mass-terminated by means of standard tools and connectors. It is constructed such that the velocity of propagation of a signal along any wire is greater than 85% of the velocity of propagation of signals along similar wires suspended in air, and such that the time delay of signal propagation from one end of any wire to the other end is less than 1.17 nanoseconds per foot of length of the cable.

4 Claims, 1 Drawing Sheet

HIGH VELOCITY PROPAGATION RIBBON CABLE

RELATIONSHIP TO OTHER APPLICATION

This application is a continuation-in-part of application Ser. No. 07/550,761 filed Jul. 10, 1990.

FIELD OF THE INVENTION

This invention relates to electrical ribbon cable.

BACKGROUND OF THE INVENTION

Heretofore ribbon cable has been made to be compatible with insulation displacement connectors, and it has been made to be shielded from electromagnetic interference. Such ribbon cables are used to transmit a plurality of electronic signals with each signal being transmitted simultaneously on a distinct wire with all the wires being capable of being terminated simultaneously. The shielding is ordinarily provided by a metallic conductive layer surrounding the ribbon cable core. The shielding shields the signals from electronic interference outside the cable as they travel the length of the cable, as well as shields electronic components outside the cable from electromagnetic interference caused by the signals within the cable.

It is desirable to maximize the velocity of propagation of signals within the wire; and, to minimize the time delay between initiation of each signal at one end of the cable and the arrival of the signal at the other end.

SUMMARY OF THE INVENTION

The desirable features described above are attained by the electrical cable of this invention, which comprises:

(a) a ribbon cable assembly comprising:
  (i) a plurality of conductive wires, spaced apart from one another in parallel coplanar alignment, each conductive wire being tape wrapped with a tape of porous sintered polytetrafluoroethylene (PTFE), and
  (ii) two sintered porous PTFE films, one such film overlying and the other such film underlying, the parallel coplanar alignment of tape wrapped conductive wires;

(b) surrounding said ribbon cable assembly, in order:
  (i) a layer of unsintered porous PTFE,
  (ii) a layer of conductive metal, and
  (iii) an outer non-conductive jacket.

A process for making an electrical cable which comprises:

(a) Wrapping a tape of porous sintered polytetrafluoroethylene (PTFE) helically around a conductive wire,
(b) Assembling a plurality of such wrapped conductive wires in a parallel coplanar alignment and placing film of porous sintered PTFE over and under said parallel coplanar alignment of wrapped conductive wires,
(c) Sintering the construction obtained in step 2,
(d) Wrapping a binder tape of porous PTFE around the construction obtained in step 3,
(e) Applying a tape wrap of copper foil about the construction obtained in step 4,
(f) Surrounding the construction obtained in step 5 with a protective jacket.

DETAILED DESCRIPTION OF THE INVENTION

Figure 1:
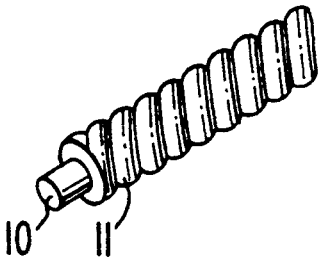
FIG. 1 represents a conductive wire 10 with a tape of sintered porous PTFE 11 helically wrapped around wire 10.
Figure 2:
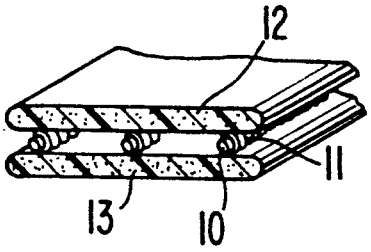
FIG. 2 represents a series of parallel coplanar wires 10 with helical wrap 11, with a layer 12 of sintered porous PTFE over the wrapped series of wires and a layer 13 of sintered porous PTFE under the wrapped series of wires.

Referring to FIG. 1, conductive wire 10 is wrapped helically i.e., spirally, with a tape of porous sintered PTFE 11. It is important in this invention to use porous sintered tape in a helically wrapped configuration, as will be apparent below. A plurality of wrapped wires are then spaced apart in a parallel coplanar fashion; and as shown in FIG. 2, are then covered on the top and bottom with sintered porous PTFE films 12 and 13. It is important to use sintered film in this step. The assembly so obtained is then sintered at above 380° C. to obtain unitary body of insulation 14 (see FIG. 3).

Figure 3:
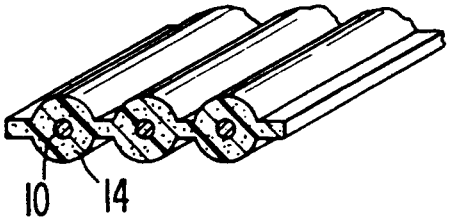
FIG. 3 represents the FIG. 2 construction after sintering, in which the layers 12 and 13 have fused with the wrap 11 to form unitary porous PTFE layer 14.

In FIG. 3, the PTFE tape wrap 11 and the PTFE films 12 and 13 have become fused to result in a unitary body of insulation 14 around conductive wires 10. In order to obtain the advantages of this invention, it is important to use sintered tape 11 wrapped around each conductor and then to protect the tape with the sintered films of porous PTFE. This is because sintering tends to reduce the porosity of porous PTFE, thus raising the dielectric constant of the PTFE 12 and 13. This of course makes the PTFE less desirable as insulation. Thus by beginning with sintered porous PTFE 11 next to the conductive wire and by protecting it with the sintered porous films 12 and 13, when this entire assembly is then sintered to fuse films 12 and 13 to tape wrap 11, the porosity remains unchanged. It is this feature that results in the high velocity of propagation of signals and the low time delay of signals.

Figure 4:
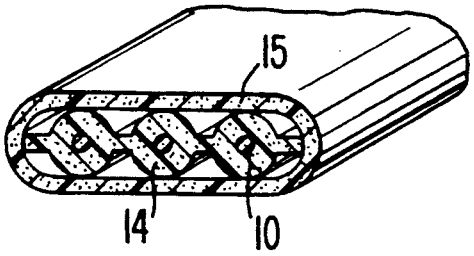
FIG. 4 represents the FIG. 3 configuration in which a binder layer of porous PTFE 15 surrounds the FIG. 3 construction.

As seen in FIG. 4, a binder layer 15 of porous PTFE is then placed around the ribbon assembly of FIG. 3. The binder layer can be either sintered or unsintered. It is conveniently placed around the ribbon assembly by tape wrapping it around the assembly either helically or cigarette wrap.

Figure 5:
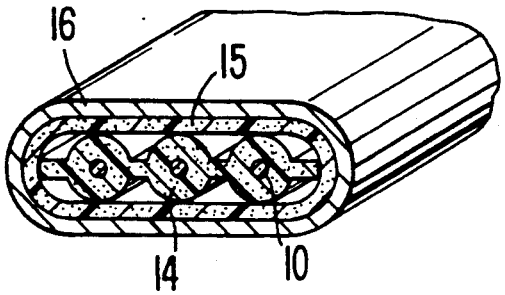
FIG. 5 represents the FIG. 4 configuration in which a layer of conductive metal 16 surrounds the FIG. 4 configuration.
Figure 6:
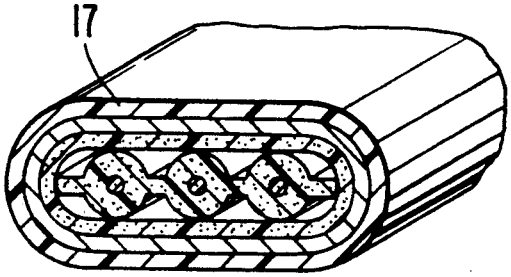
FIG. 6 represents the FIG. 5 configuration in which a protective jacket 17 surrounds the construction of FIG. 5.

Surrounding that, as seen in FIG. 5, is a layer of shielding 16 of a conductive metal, such as copper foil; and surrounding that, as shown in FIG. 6, is a protective layer or jacket 12 of a nonconductive material, such as a polyurethane.

Porous polytetrafluoroethylene (PTFE) is of low density because of the porosity. Porous PTFE can be made as described in U.S. Pat. No. 3,953,566 by expanding ordinary PTFE. The more porous the PTFE insulation, the greater the increase in velocity of propagation. The PTFE is sintered to provide strength to the cable and protect the unsintered PTFE.

Shielding 16 absorbs electromagnetic radiation emitted by the wires and also absorbs electromagnetic radiation from outside the cable.

EXAMPLE

Example 1

Conductor wires, each of 30 gauge solid copper wire, were formed into a core cable by helically wrapping each wire with porous sintered PTFE tape. Then the wires were arranged in parallel in one plane, and a film of porous sintered PTFE was positioned on both sides of the wrapped wires. Then the entire construction was sintered at about 400° C. to coalesce the individually wrapped wires into one unitary insulation and, at the same time to bond the wrapped wires to the two films to form one unitary insulative material around the conductive wires. Total cable thickness was 0.025 inches. A binder layer of porous polytetrafluoroethylene (unsintered), 0.008 inches thick, was applied around the resulting ribbon cable by means of tape-wrapping along the length of the cable. A layer of perforated copper foil 0.002 inches thick was then applied by means of tape-wrapping around the entire construction to provide shielding. Finally, an outer nonconductive layer of a polyurethane of thickness 0.020±0.010 inches was applied by means of extrusion to provide a protective jacket.

The wires were located such that the distance between adjacent wires was 0.050±0.003 inches and the distance between centers of non-adjacent conductors was held to a tolerance of 0.015 inches. The cable thus made was terminated by means of common, readily available insulation displacement connectors, using a common compression press, such that all wires were mass-terminated in a single operation.

The cable assembly thus formed was connected to a digital signal generator and a plurality of signals were transmitted along the length of the cable. The velocity of propagation of these signals was 89% of that achieved by similar conductors when similar signals are transmitted down such conductors when such conductors are suspended in air. The time required, i.e., the time delay, to transmit such signals from one end of the cable assembly to the other was 1.15 nanoseconds per foot of length of the assembly.

The speed at which the signals are transmitted is maximized, preferentially greater than 85% of the velocity of propagation of a similar signal along a similar wire which has been suspended in air or vacuum, and the time delay between the initiation of each signal at one end of the cable and the arrival of the signal at the other end of the cable is minimized, preferentially less than 1.17 nanoseconds per foot of the length of the cable.

We claim:

1. An electrical cable made by (a) Wrapping a tape of porous sintered polytetrafluoroethylene helically around each of a plurality of conductive wires, (b) Assembling said plurality of wrapped conductive wires in a parallel coplanar alignment and placing film of porous sintered PTFE over and under said parallel coplanar alignment of wrapped conductive wires, (c) Fusing the construction obtained in step (b), (d) Wrapping a binder tape of porous PTFE around the construction obtained in step (c), (e) Applying a tape wrap of copper foil about the construction obtained in step (d), (f) Surrounding the construction obtained in step (e) with a protective jacket.

2. A process for making an electrical cable which comprises:

(a) Wrapping a tape of porous sintered polytetrafluoroethylene helically around each of a plurality of conductive wires, (b) Assembling said plurality of wrapped conductive wires in a parallel coplanar alignment and placing film of porous sintered PTFE over and under said parallel coplanar alignment of wrapped conductive wires, (c) Fusing the construction obtained in step (b).

3. The produce made by the process of claim 2.

4. The product of claim 3 wherein the velocity of signal propagation along any or all of the wires exceeds 85% of the velocity of propagation of signals along such conductive wires when such wires are suspended in air or vacuum, and wherein the time required for a signal to travel along any of the conductive wires is less than 1.17 nanoseconds per foot of length of the cable.

* * * * *